United States Patent [19]

Alfonso Berbegal

[11] 4,027,416

[45] June 7, 1977

[54] ARTICULATION DEVICE FOR GUNSTOCKS OF LONG FIREARMS

[76] Inventor: Jose Luis Alfonso Berbegal, 5-7 Oviedo St., Zaragoza, Spain

[22] Filed: Nov. 11, 1975

[21] Appl. No.: 631,179

[30] Foreign Application Priority Data

Nov. 19, 1974 Spain ..... 207609[U]

[52] U.S. Cl. ..... 42/73; 42/71 R

[51] Int. Cl.² ..... F41C 23/00

[58] Field of Search ..... 42/73, 71 R, 72, 75 C

[56] References Cited

UNITED STATES PATENTS

| | | | |
|---|---|---|---|
| 2,187,640 | 1/1940 | Bost | 42/75 C |
| 2,587,248 | 2/1952 | Turner | 42/73 |

FOREIGN PATENTS OR APPLICATIONS

| | | | |
|---|---|---|---|
| 1,910,375 | 9/1970 | Germany | 42/71 R |
| 112,228 | 10/1925 | Switzerland | 42/73 |

*Primary Examiner*—Charles T. Jordan

*Attorney, Agent, or Firm*—Ostrolenk, Faber, Gerb & Soffen

[57] ABSTRACT

In a gunstock, the gunstock being divided into a firearm connecting section and a firearm user's body section; between the two sections are positioned a plurality of insert pieces, at least one of which is wedge shaped, with the wedge narrowing toward either the top or the bottom of the gunstock, and fastening means holding the entire gunstock securely together.

9 Claims, 6 Drawing Figures

ARTICULATION DEVICE FOR GUNSTOCKS OF LONG FIREARMS

This invention relates to a device designed for the express purpose of making possible the adaptation of the gunstock of a firearm of the aforementioned type to the personal characteristics of the marksman, with the advantage and new effect that such adaptation of the stock is achieved without definitive prejudice to the firearm, or in other words, the modification made does not mean that the firearm will not be able to be adapted once again to the personal characteristics of a third party, when the firearm changes owner, for example.

It is a proven fact that each marksman has his own special measurements and characteristics to which the firearm to be used must be adapted. And in virtue of this unavoidable need, it is frequent to see that the firearms of marksmen, especially for competitions, tend to have their stocks modified on the basis of patches and other additions, or with the varnish and finish spoiled, because the wood of the stock had to be shaved off where aim is taken, in order to adapt them to the measurements of their owners. This takes away from a new firearm and it is devaluated as soon as it is adapted to a particular marksman. Also, it is then more difficult to sell, as it would only serve for another marksman with similar measurements and shooting technique, which is difficult to encounter in reality.

The drawback explained above has motivated the invention of this articulation device for preferably long firearms, although this does not necessarily mean that it cannot be used or applied to another type of firearm capable of receiving such a means of personal adaptation, which, in order to clarify the content of this technical description, is shown on the attached drawing, according to one of the possible cases of real execution of the device claimed, and consequently, this example should be interpreted as of an illustrative character, with no limitation of any kind whatsoever insofar as the possible variations which its details of an accessory nature could offer in each case of specific application or realization, in relation to the needs or preferences of the marksman.

Figure 1:
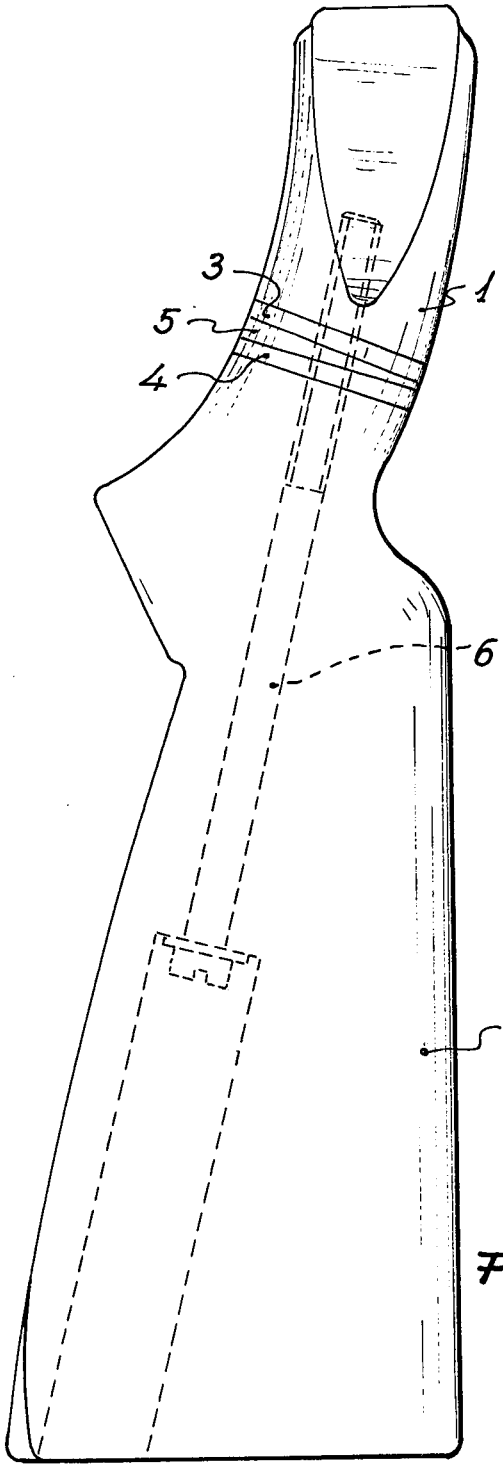

The following designs are shown on the sheet of drawings:

FIG. 1. Side view of the stock of a long firearm of conventional or undetermined characteristics (thus excluded from this claim), in which, through transparency, the drill hole occupied by the fastening screw joining the two parts of the gunstock is illustrated. In this drawing the linking device can be seen mounted after the assembling of the stock.

Figure 2:
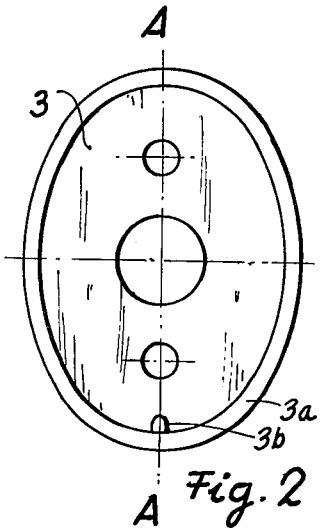

FIG. 2. Front view of one of the parts of the device that is fastened to the forward part of the gunstock.

Figure 3:
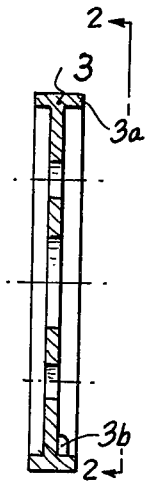

FIG. 3. Cross-section of the same part through line A—A of the preceding drawing.

Figure 4:
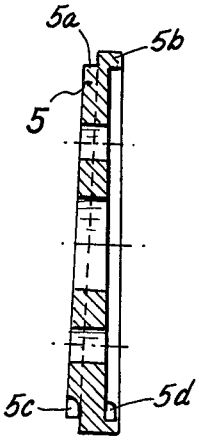

FIG. 4. The same section of the intermediate part of the device.

Figure 5:
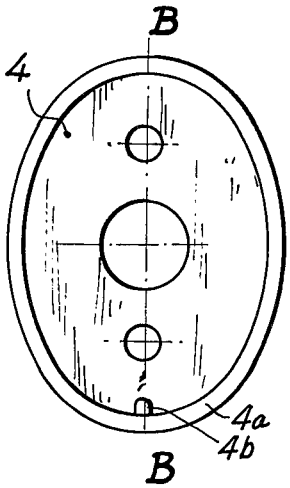

FIG. 5. Front view of the third component part of the device claimed, which is attached to the back part of the gunstock.

Figure 6:
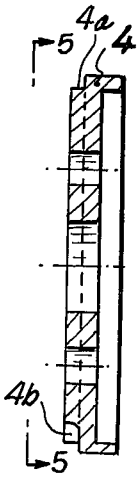

FIG. 6. Cross-section of the third part through line B—B of the preceding drawing.

In accordance with the identification code used in these designs in order to locate the points of special significance, as well as the component parts and elements of the articulation device for gunstocks of long firearms, the construction characteristics of the mechanism shall be explained below.

The purpose is thus to protect the aforementioned device designed to vary the conformation of the gunstocks of long firearms preferably and in particular for competition, such as shotguns, sporting rifles, etc., according to which, provision has been made for a gunstock divided into two parts, the forward part 1 being joined to the firearm itself (FIG. 1) and the back part 2, which is the part with which the marksman takes aim.

The device for which protection is sought is placed between both of these parts, and is basically made up by three parts (FIGS. 2 to 6), whose purposes is to make possible the adjustment of the firearm to each marksman in a personal manner in accordance with his particular circumstances or anatomical characteristics, as expressed below.

Part 3 (FIGS. 2 and 3) is rigidly attached by any appropriate means to the forward part of the stock 1. As shown in FIGS. 2 and 3, part 3 has a peripheral rim 3*a* adapted to nest, in tonque in groove fashion, in a peripheral recess 5*a* in one side of the below described intermediate part 5. Part 4 (FIGS. 5 and 6) will be fixed in a similar fashion to the back section 2 of the stock 1. As shown in FIGS. 5 and 6, part 4 has a peripheral recess 4*a* adapted to receive, in tongue in groove fashion, a peripheral rim 5*b* projecting from the opposite side of the below described intermediate part 5. The device is completed by a third intermediate part 5 (FIG. 4), which fits in between the two aforementioned components 3 and 4, in such a way that once these have been joined, both parts of the gunstock, thanks to the screw 6, the last element to be assembled, form a solid block. The part 5 receives the rim 3*a* in its recess 5*a* and its rim 5*b* is received in the recess 4a.

For preventing axial rotation of the stock sections 1 and 2 and of the parts 3, 4 and 5 with respect to each other, the side of part 3 having rim 3*a* thereon also has a projection 3*b* which is received in a cooperating slot 5*c* on the facing side of part 5 and the opposite side of part 5 has a projection 5*d* thereon which is received in a cooperating slot 4*b* on the side of part 4 having the recess 4*a* defined therein.

The intermediate part 5 is shown in the attached designs as an example, as mentioned earlier, and as can be seen in FIG. 4, it has a wedge shape, in order that when it has been assembled with its thicker part downwards, (FIG. 1), the back part of the gunstock 2, where the marksman rests his face, is lifted or will be moved upwards, in relation to the rest of the firearm, and the section where the marksman takes aim is thus modified.

If on the contrary, this wedge 5 is mounted with the thick part upwards, the back part 2 of the gunstock will go down or lower its alignment with respect to the firearm itself.

Naturally, the size and shape of the three component parts of the device will be variable and, of course, will adapt perfectly in each case to the exterior form and measurements of the grip of the gunstock so that, once they have been assembled, they will form a single block with no protrusions or gaps in the surface.

Besides the reservation made in the preceding paragraph, it is likewise stated that each gunstock is capable of being provided with a variable number of intermediate parts 5, and these may have different wedge sizes or thicknesses, both vertically as well as horizontally, for which purpose the aforementioned parts 5 will be arranged under the construction point of view in such a way that they will fit in with each other and the end parts 3 and 4. In this manner, it is possible to place between these end pieces one or more wedges 5 until the firearm is perfectly adjusted to the anatomical characteristics of each marksman without having to make the manipulations, which up to now, have been effected, definitively prejudicing the appearance and finish provided by the manufacturer of the firearm, and in this manner, achieve the possibility of obtaining the adaptation of the latter to any marksman whomsoever and to any type of shooting whatsoever with the mere incorporation of the wedges of the measurements needed in each case.

Having described and represented the subject of this protection in sufficient extent and with clarity in order to allow its being put into practice, it is declared as an original invention and as not having been used in Spain, with the general reservation-besides those already set forth in this report-that the accidental details of shape, size and materials used in its construction will be capable of alteration without detracting from the essential nature of the invention, which is summed up in the following This Utility Model, applied for in Spain for 20 years, is to encompass the following claims:

1. Articulation device for a gunstock: said gunstock comprising an elongated body which is divided into two sections, including a first section attachable to the firearms supported by said gunstock and a second section emplaceable against the body of the user; each said section of said gunstock having a surface facing toward a cooperating surface on the other said section of said gunstock, which said cooperating surfaces are securable together for forming a unitary gunstock; said gunstock having at least first and second opposite sides;

between said gunstock sections and in engagement with the cooperating surfaces thereof is positioned a plurality of insert pieces placed one next to the other in a line, which together are of a thickness sufficient to change the length of said gunstock when said sections of said gunstock are fastened together with said insert pieces therebetween;

a first said insert piece having respective third and fourth opposite, outwardly facing sides with said third side facing toward said gunstock first section and said fourth side facing toward said gunstock second section; one of said third and fourth sides having a first peripheral rim extending thereabout and projecting therefrom and the other of said third and fourth sides having a first peripheral recess defined therein;

a second said insert piece positioned between said first insert piece and said gunstock first section; said second insert piece having a fifth side facing toward said first insert piece;

a third insert piece positioned between said first insert piece and said gunstock second section; said third insert piece having a sixth side facing toward said first insert piece;

the one of said fifth and said sixth sides facing toward said first peripheral rim having a second peripheral recess shaped and positioned to receive said first peripheral rim in tongue in groove fashion; the other of said fifth and said sixth sides facing toward said first peripheral recess having a second peripheral rim shaped and positioned to project into and be received in said first peripheral recess in tongue-in-groove fashion, thereby aligning all said insert pieces;

fastening means extending between said gunstock sections for holding same securely together.

2. The articulation device of claim 1, wherein said first insert piece is wedge shaped, with said first insert piece having a wider end and a narrower end; said first insert piece wider end being at said first gunstock side and said first insert piece narrower end being at said second gunstock side.

3. The articulation device of claim 2, wherein said second gunstock side is said top side thereof and said first gunstock side is the bottom side thereof.

4. The articulation device of claim 2 wherein said first and said third insert pieces engage the respective said gunstock cooperating surfaces toward which those said insert pieces face.

5. The articulation device for gunstocks of claim 4, wherein said third side has said first peripheral recess defined therein and said fourth side has said first peripheral rim projecting therefrom.

6. The articulation device for gunstocks of claim 5, further comprising a first projection from said fifth side and a first slot located in said third side and receiving said first projection; a second projection from said fourth side and a second slot located in said sixth side and receiving said second projection; said first and second projections and slots being for preventing rotation of said gunstock sections and of said insert pieces with respect to each other and around an axis extending lengthwise of said gunstocks.

7. The articulation device for gunstocks of claim 1, wherein said fastening means comprises a screw connection wherein a screw receptacle is provided in said gunstock first section and a screw passes through and engages said gunstock second section and extends into and is tightened into said receptacle, thereby holding said gunstock sections securely together.

8. The articulation device for gunstocks of claim 1, wherein said third side has said first peripheral recess defined therein and said fourth side has said first peripheral rim projecting therefrom.

9. The articulation device of claim 8, further comprising a first projection from said fifth side and a first slot located in said third side and receiving said first projection; a second projection from said fourth side and a second slot located in said sixth side and receiving said second projection; said first and second projections and slots being for preventing rotation of said gunstock sections and of said insert pieces with respect to each other and around an axis extending lengthwise of said gunstocks.

* * * * *